United States Patent [19]

Wilson

[11] 4,082,041

[45] Apr. 4, 1978

[54] DIRECTIONAL FLARE

[76] Inventor: John S. Wilson, 3 Kelldon Dr., Felton, Calif. 95018

[21] Appl. No.: 727,735

[22] Filed: Sep. 29, 1976

[51] Int. Cl.[2] ..... F42B 4/28

[52] U.S. Cl. ..... 102/35; 102/87

[58] Field of Search ..... 102/35, 35.2, 35.4, 102/35.6, 37.8, 60, 87

[56] References Cited

U.S. PATENT DOCUMENTS

| | | | |
|---|---|---|---|
| 1,899,518 | 2/1933 | Moore | 102/37.8 |
| 3,393,967 | 7/1968 | Fleishman et al. | 102/37.8 |
| 3,499,385 | 3/1970 | Douda | 102/35 |
| 3,893,396 | 7/1975 | Simmons | 102/35 |

*Primary Examiner*—Verlin R. Pendegrass

*Attorney, Agent, or Firm*—Townsend and Townsend

[57] ABSTRACT

A directional flare system is disclosed. A flare is used which emits light generally isotropically when actuated. An opaque shield is located to one side of the flare to prevent the transmission of light from the flare throughout a preselected sector about a vertical axis passing through the flare. Means are provided for maintaining the opaque shield in a preferred angular orientation about the vertical axis.

15 Claims, 4 Drawing Figures

DIRECTIONAL FLARE

BACKGROUND OF THE INVENTION

The present invention relates to flares, and in particular to a directional flare which provides illumination only throughout a preselected sector.

Flares are sometimes used to provide intense illumination at night. The flare is customarily launched using a specially designed pistol device or other launcher, and at the peak of the trajectory a parachute is released so that the flare floats slowly down to earth. While the flare is suspended in the air, it illuminates the ground or sea beneath. Such flares are often used in emergency and wartime situations in which night illumination is required.

A difficulty with the use of flares as described above is that the illumination of the flare falls not only on the area viewed, but on the viewer and his surroundings as well. In war the illumination of friendly territory or ships has obvious dangers. Furthermore, the sudden illumination provided by the flare at night may dazzle the user of the flare, making it difficult for him to see objects illuminated by the flare, and substantially defeating the flare's purpose.

SUMMARY OF THE INVENTION

A directional flare system is disclosed. A flare is used which emits light generally isotropically when actuated. An opaque shield is located to one side of the flare to prevent the transmission of light from the flare throughout a preselected sector about a vertical axis passing through the flare. Means are provided for maintaining the opaque shield in a preferred angular orientation about the vertical axis.

The primary object of the present invention is to shield the user of the flare and his surroundings from illumination. The opaque shield is controlled so that the shield is located between the user of the flare and the flare itself. The area to be viewed will still be illuminated by the flare. As a result, the user of the flare and his surroundings will not be illuminated, which might cause danger in a war situation, and the user is not dazzled by his own flare.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
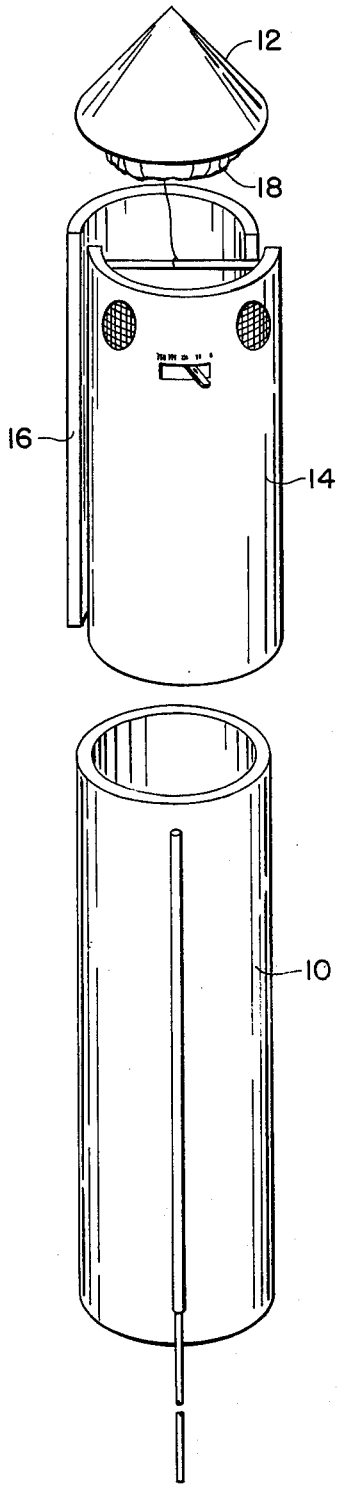
FIG. 1 is a perspective view of the preferred embodiment of the directional flare of the present invention with parts separated to show major units at time of launch.
Figure 2:
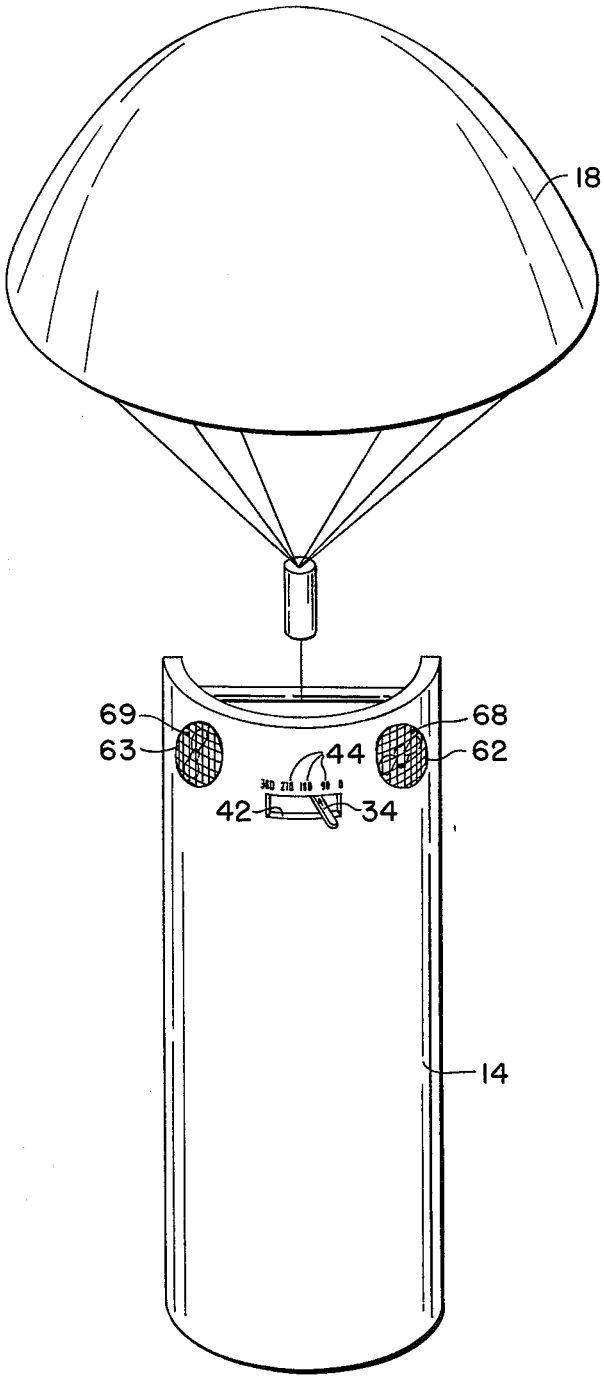
FIG. 2 is a perspective view of the embodiment of the present invention illustrated in FIG. 1 after parachute release as viewed from behind the shield.

The mechanism by which the preferred embodiment of the flare system of the present invention can be launched is illustrated by way of reference to FIG. 1. The flare system includes a propulsion mechanism 10 which propels the apparatus into the air, a protective cap 12, an opaque shield 14 and a dummy shield 16. The flare itself is not visible in FIG. 1, but is attached to the inside of shield 14. After the flare system has reached the apogee of its trajectory, cap 12, dummy shield 16 and launcher 10 separate from shield 14 and fall to earth. Shield 14 remains suspended by means of a parachute 18 as illustrated in FIG. 2. Of course, instead of parachute 18 the flare could be suspended from a balloon, or attached to a manned or unmanned airplane or helicopter.

Figure 3:
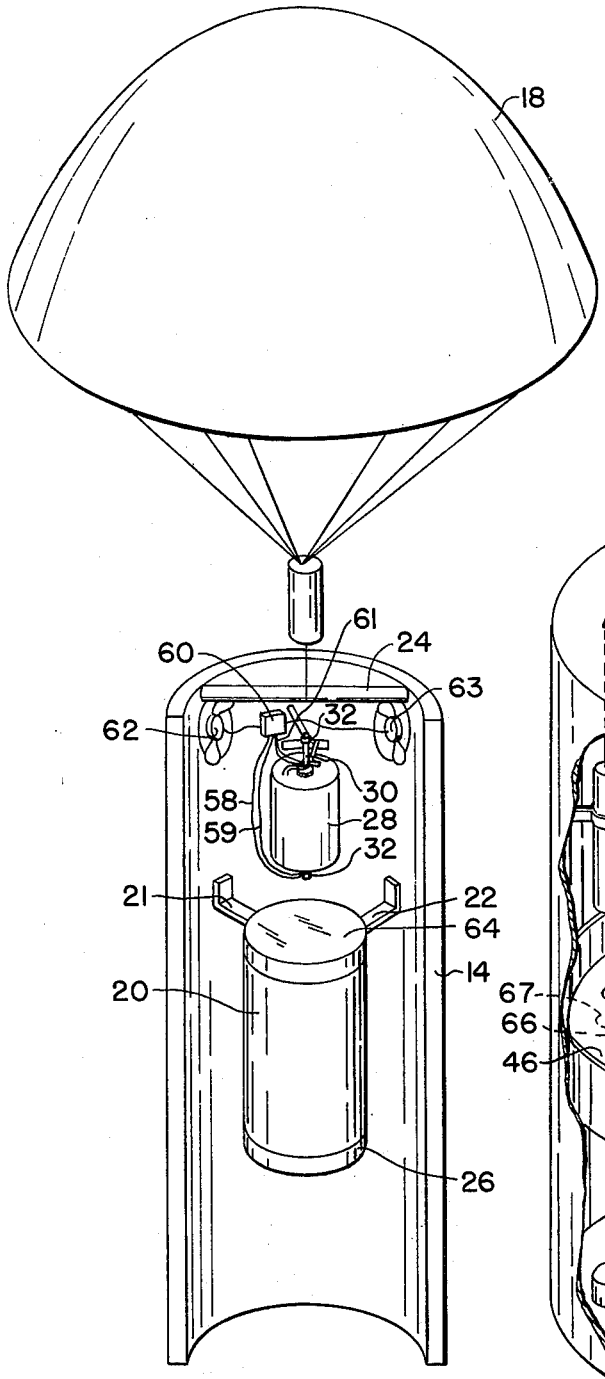
FIG. 3 is a perspective view similar to that of FIG. 2 as viewed from in front of the shield.

The configuration of the flare assembly of the present invention after parachute release is illustrated by reference to FIGS. 2 and 3 in combination. Opaque shield 14 is suspended from parachute 18 so that the opaque shield falls slowly to earth. Opaque shield 14 is preferrably semicylindrical as illustrated, but could also comprise a flat plate or other configuration. Flare 20 is suspended along the central axis of shield 14 by means of brackets 21, 22. Parachute 18 is secured to opaque shield 14 along a rod 24 so that the system is balanced and the axis of semicylindrical shield 14 and flare 20 will be vertical.

An igniter 26 is attached to one end of flare 20 and ignites the flare after parachute release. When ignited, flare 20 will emit light generally isotropically (i.e., equally along all axes except where the flare itself blocks the light). However, the transmission of light from flare 20 throughout a preselected sector about the axis of opaque shield 14 is blocked by the shield. Accordingly, the emitted light falls only on the remaining sector. The interior surface of shield 14 may be reflective to concentrate the emitted light in the sector not blocked by the shield.

Figure 4:
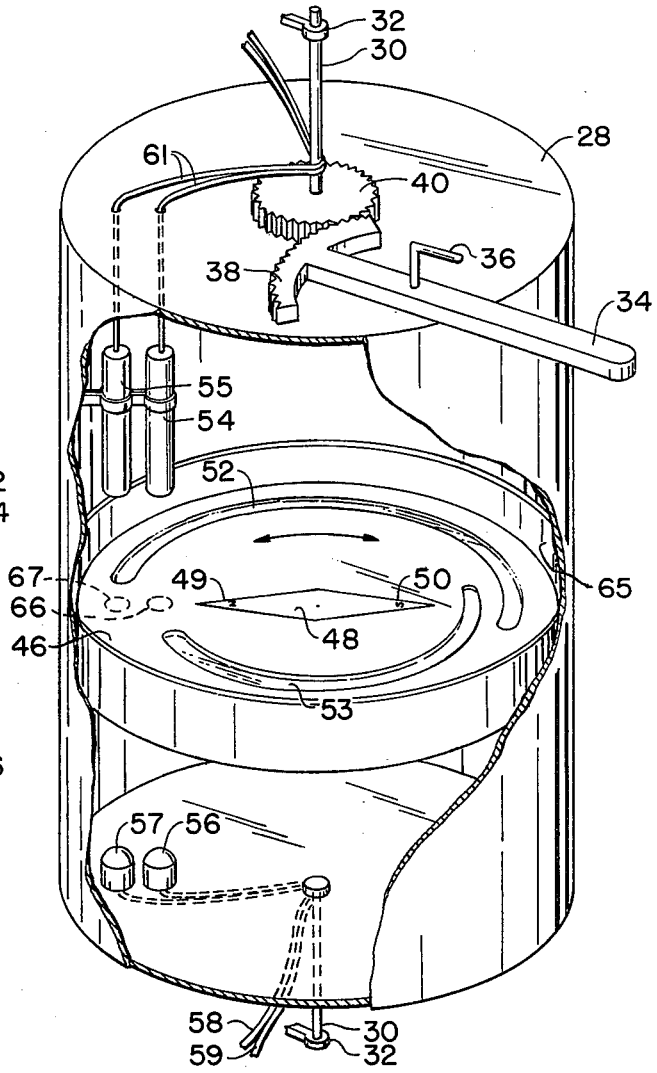
FIG. 4 is a fragmentary elevation view of one embodiment of the control mechanism of the present invention.

A sensor drum 28 is mounted to the interior of opaque shield 14 on shafts 30. Shafts 30 are rotatably mounted to brackets 32 emanating from shield 14. (See also FIG. 4).

An arm 34 is pivotably mounted to the interior of shield 14 by bracket 36. Arm 34 has a gear rack 38 at one end which meshes with a pinion gear 40 fixed to shaft 30. The end of arm 34 opposite gear rack 38 projects outwardly through a slot 42 in opaque shield 14 (See FIG. 2). The end of arm 34 projecting through slot 42 can be manipulated manually to rotate drum 28. Indicia 44 are disposed immediately above slot 42 to indicate the relative position of arm 34. Indicia 44 represent compass bearings, the purpose of which will be described hereinafter.

A compass card 46 is located in a housing 65 with transparent top and bottom, and said compass card is freely rotatable within said housing. Compass card 46 includes a magnetic needle 48 having one end 49 thereof which points toward north and another end 50 thereof which points south. Since the compass card 46 is freely rotatable it will always align itself with reference to the magnetic north and south poles of the earth when opaque shield 14 is suspended from the parachute and is reasonably stable. In conformance with a common technique, compass card 46 is able to rotate freely when housing 65 is slightly tilted.

A pair of semicircular slots 52, 53 are disposed about the central axis of compass card 46. Slots 52, 53 overlap at the south facing end of the card and a slight gap is left between them at the north facing end of the card. A pair of light sources 54, 55 powered by control box 60 through wires 61 are disposed immediately above compass card 46 and are aligned with the respective slots 53, 52. A pair of photocells 56, 57 are located beneath compass card 46 and are also aligned with light sources 54, 55 respectively.

Before the flare system of the present invention is launched, lever 34 is positioned by reference to indicia 44 so that opaque shield 14 will attain and maintain the desired orientation after parachute 18 has opened. Lever 34 is moved so that light sources 54, 55 are disposed toward the north with respect to shafts 30 when opaque shield 14 is properly aligned. When compass card 46 has stabilized, and if shield orientation is correct, the light from sources 54, 55 is blocked by the compass card, forming illuminated spots 66 and 67. Light does not reach photocells 56, 57 and no signal is sent through wires 58, 59 to control box 60.

If opaque shield 14 is not properly oriented immediately after parachute release, or if opaque shield 14 alters its position after being properly oriented, compass card 46 is rotated relative to light sources 54, 55 because the compass card will maintain its position relative to magnetic north. As a result, the light from one of the sources 54, 55 will shine through its corresponding slot 53, 52 to be detected by one of the photocells 56, 57. A signal is sent along one of the wires 58, 59 to control box 60 which indicates the direction in which opaque shield 14 must be moved. Accordingly, control box 60 actuates one of two fans 62, 63, protected by grills 68, 69, to rotate opaque shield 14 about its axis until the opaque shield has returned to its proper orientation.

It has been noted that semicircular slots 52, 53 overlap at the south facing end of compass card 46. If drum 28 is so positioned that light sources 54, 55 direct light through the overlapping portions of the slots, photocells 56, 57 will be illuminated simultaneously. This occurs when opaque shield 14 is oriented 180° from the required position. To avoid ambiguity in the direction of shield rotation under this circumstance, rotation takes place in an arbitrary and preselected direction. Rotation continues until the shield is correctly oriented.

In operation, the selection of the proper alignment of opaque shield is done prior to launch of the flare system by manipulating arm 34. Once the proper orientation of the opaque shield has been preselected, the flare can be launched in a conventional manner. If the system malfunctions, a self-destruct device 64 can be actuated. If the system functions properly, the opaque shield will prevent the illumination of a preselected area, greatly enhancing the utility of the flare system.

While a preferred embodiment of the present invention has been illustrated in detail, it is apparent that modifications and adaptions of the embodiment will occur to those skilled in the art. For example, while one sensing and control system has been described, a wide variety of such systems could be incorporated within the system of the present invention. Further, the two fans can operate simultaneously, aiding each other in bringing about rotation of opaque shield 14 in the required direction. Also, rather than the fans used for propulsion, gas jets or other propulsive mechanisms could be used. However, it is to be expressly understood that such modifications and adaptations are within the spirit and scope of the present invention, as set forth in the following claims.

What is claimed is:

1. A directional flare system comprising:

a flare adapted to emit light generally isotropically when actuated;

an opaque shield located to one side of said flare and adapted to prevent the transmission of light from the flare throughout a preselected sector about a vertical axis passing through the flare;

means for suspending the opaque shield and the flare in the air while the flare is emitting said light; and means for automatically maintaining the opaque shield in a preferred angular orientation about said vertical axis while the the flare is emitting said light.

2. A flare system as recited in claim 1 wherein said maintaining means includes a pair of fans mounted to said opaque shield, and means for actuating said fans to maintain the opaque shield in the preferred angular orientation.

3. A flare system as recited in claim 1 wherein said maintaining means includes a magnetic sensor adapted to sense the angular orientation of the opaque shield relative to the magnetic field of the earth, and means for orienting the opaque shield responsively to said magnetic sensor.

4. A flare system as recited in claim 1 wherein the opaque shield has a generally semicircular cross section in a plane perpendicular to said vertical axis.

5. A flare system as recited in claim 1 wherein said suspending means comprises a parachute.

6. In a flare system comprising a suspending means and a flare depending from said suspending means and adapted to emit light generally isotropically when actuated, the improvement comprising an opaque shield partially circumscribing said flare about a vertical axis and adapted to substantially prevent the transmission of light from the flare throughout a preselected sector about said vertical axis; and means for automatically maintaining the opaque shield in a preferred angular orientation about said vertical axis.

7. A flare system as recited in claim 6 wherein said suspending means comprises a parachute.

8. A directional flare system comprising:

a flare adapted to emit light generally isotropically when actuated;

an opaque shield partially circumscribing said flare about a vertical axis and adapted to prevent the transmission of light from the flare throughout a preselected sector about said vertical axis;

means for sensing the angular orientation of said opaque shield about said vertical axis;

means for angularly propelling the opaque shield about said vertical axis responsive to said sensing means to maintain the opaque shield in a preferred angular orientation; and a parachute connected to the opaque shield and to the flare so that the opaque shield and flare are suspended from the parachute.

9. A flare system as recited in claim 8 wherein said propelling means includes a pair of fans mounted to said opaque shield.

10. A flare system as recited in claim 8 wherein said sensing means comprises a magnetic sensor adapted to sense the angular orientation of the opaque shield relative to the magnetic field of the earth.

11. A flare system as recited in claim 8 in additionally comprising means for self-destructing the flare upon malfunction of the sensing means.

12. A directional flare system comprising:

a flare adapted to emit light generally isotropically when actuated;

an opaque shield partially circumscribing said flare about a vertical axis and adapted to prevent the transmission of light from the flare to a preselected sector about said vertical axis;

a selectably rotatable drum mounted to said opaque shield;

a freely rotatable compass card located within said drum;

means for sensing movement of the drum relative to the compass card to determine changes in the angular orientation of the opaque shield;

means for angularly propelling the opaque shield about said vertical axis responsive to said sensing means to maintain the opaque shield in a preferred angular orientation; and a parachute connected to the opaque shield and to the flare so that the opaque shield and the flare are suspended from the parachute.

13. A directional flare system comprising:

a flare adapted to emit light generally isotropically when actuated;

an opaque shield located to one side of said flare and adapted to prevent the transmission of light from the flare throughout a preselected sector about a vertical axis passing through the flare;

means for sensing the angular orientation of said opaque shield about said vertical axis;

means for rotating the opaque shield about said vertical axis responsive to said sensing means to maintain the opaque shield in a preferred angular orientation; and means for suspending the flare, opaque shield, sensing means, and rotating means in the air while the flare is emitting said light.

14. A flare system as recited in claim 13 wherein said maintaining means includes a pair of fans mounted to said opaque shield, and means for actuating said fans to maintain the opaque shield in the preferred angular orientation.

15. A flare system as recited in claim 13 wherein said maintaining means includes a magnetic sensor adapted to sense the angular orientation of the opaque shield relative to the magnetic field of the earth, and means for orienting the opaque shield responsively to said magnetic sensor.

* * * * *